US005518814A

United States Patent [19]

Bönigk

[11] Patent Number: 5,518,814

[45] Date of Patent: May 21, 1996

[54] FLAT MULTIFILAMENT YARN HAVING LOW OPENING TENDENCY AND GOOD COMPACTION

[75] Inventor: Burkhard Bönigk, Königsbrunn, Germany

[73] Assignee: Hoechst Aktiengesellschaft, Germany

[21] Appl. No.: 279,254

[22] Filed: Jul. 21, 1994

[30] Foreign Application Priority Data

Jul. 23, 1993 [DE] Germany ..... 43 24 752.0

[51] Int. Cl.[6] ..... D02G 3/00

[52] U.S. Cl. ..... 428/365; 428/198; 428/357; 428/360; 428/372; 57/243; 57/248; 57/903; 57/908

[58] Field of Search ..... 428/198, 357, 428/360, 365, 372; 57/153, 903, 908, 230, 243, 248; 161/173, 175, 176

[56] References Cited

U.S. PATENT DOCUMENTS

| | | |
|---|---|---|
| 2,985,995 | 5/1961 | Bunting, Jr. . |
| 3,563,021 | 2/1971 | Gray . |
| 3,701,248 | 10/1972 | Gray . |
| 4,943,602 | 7/1990 | Brueckmann . |

FOREIGN PATENT DOCUMENTS

| | | |
|---|---|---|
| 1313753 | 7/1988 | Canada . |

OTHER PUBLICATIONS

Chemiefasern/Textilindustrie 29(10), S. 862–64 (1979).
Synthesefasern, Grundlagen, Technologie, 1981, 334, 335.

*Primary Examiner*—Patrick J. Ryan
*Assistant Examiner*—Merrick Dixon
*Attorney, Agent, or Firm*—Connolly & Hutz

[57] ABSTRACT

Described is a flat multifilament yarn with minimal opening tendency of the mutually bound-together filaments, expressed by the quantity $VS(K_F)>42\%$ and with good compaction, expressed by the quantity $(VG_{mean}/VG_{max}) * 100\%>45\%$ the VG quantities being degrees of intermingling determined using the Rothschild needle tester model 2040, $VG_{mean}$ being the arithmetic mean of 20 needle test measurements, and $VG_{max}$ being the maximum value of 20 needle test measurements. $VS(K_F)$ is the intermingling stability at a given total yarn tension $K_F$ determined by measuring the opening tendency of the flat multifilament yarn under dynamic-mechanical stress by a specific method.

15 Claims, 1 Drawing Sheet

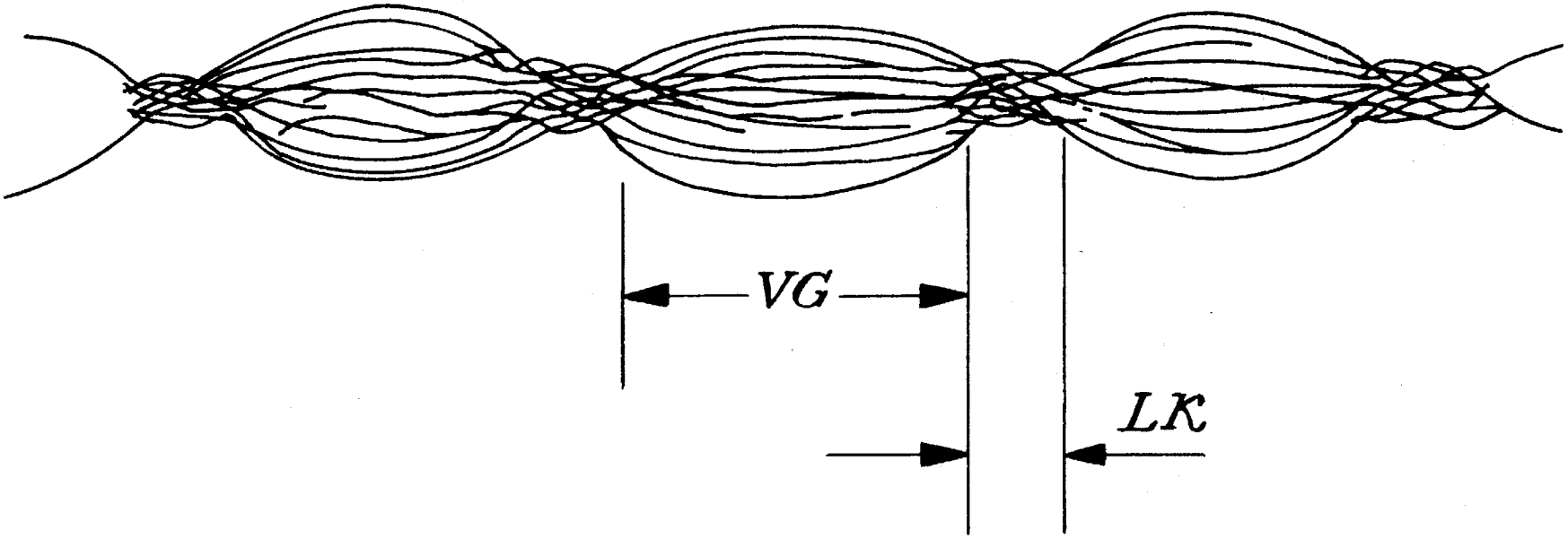
LK
VG

FLAT MULTIFILAMENT YARN HAVING LOW OPENING TENDENCY AND GOOD COMPACTION

DESCRIPTION

Flat multifilament yarn having low opening tendency and good cohesion, production of flat multifilament yarns, and use thereof.

The present invention relates to a flat multifilament yarn of good cohesion, a process for producing flat multifilament yarns, and to their use, in particular in the form of warps which are weavable without size.

Used as a warp thread in a weaving machine, a yarn is subject to a multiplicity of mechanical stresses. They include effects due to the dynamic stretching of the yarn, which can lead to loosening of the size film, to partial undoing of the intermingling, and to the abrasion between adjacent warp threads. Furthermore, the incremental passage through the warp thread guide causes an abrasion of the yarns against the lamellae; the continuous change of shed is responsible for a relative movement between adjacent filaments, resulting in abrasion and stretching of the filaments; in the needles the filaments are subject to a multiple stress, such as rubbing or bending; the read causes abrasion and high relative movement. In addition, the yarns are damaged by function elements of the loom, for example by relay jets, which, by cutting into the yarn, can destroy the interfilament cohesion and can cause filament breakages, which can ultimately lead to broken ends.

To render warp threads more resistant to the mechanical stress of weaving and at the same time to stick projecting fibers or filaments to the yarn, yarns are sized. The sizing of warps from the processing from natural staple fiber yarns has been known for a long time (cf. for example Falkai et al., Synthesefasern, pp. 334–5, Verlag Chemie, 1981). The size is intended to bind together the filaments of the yarn for the weaving process, but to leave the yarns readily separable from one another for shed formation.

This contradictory requirement also applies to yarns made of synthetic fibers and also to multifilament yarns. It is known that multifilament yarns with a sufficiently high cohesion due to a high level of twist need not be sized. However, imparting a high level twist to a yarn is a complicated and particularly cost-intensive process and, what is more, has a long-lasting effect on the appearance, the tactile properties and the drape of the textile fabric produced from such yarns.

U.S. Pat. No. 2,985,995 describes a compact intermingled yarn which is virtually free of twist and can be treated without additional adhesive, such as sizes, in textile further processing processes. Although according to the description such further processing processes also include weaving, such yarns, in particular flat multifilament yarns, have hitherto not become established on the market for use as size-free warp yarns. One of the reasons is that such yarns are prone to frequent breakage under the stresses encountered on weaving machines, so that continuous operation over a prolonged period is not possible.

Further reasons are that the trouble-free processing of such yarns does not meet the requirements of modern high-speed weaving machine systems, where the frequency of weft insertion, for example on the basis of air or water, ranges from more than 300/min to 1200/min or higher, and/or is only possible in non-critical constructions without insufficient thread density in warp and weft.

DE-A-2,008,338 discloses a jet-textured yarn which, according to the observations made therein, can be used as a warp yarn in weaving without the use of a size. Such yarns can be used without size directly in shuttle looms or they can also be used as warp yarns in water jet looms. Modern air weaving machines and also the latest developments in water weaving machines differ from the weaving machines mentioned in DE-A-3,008,338 in having a very much higher weft insertion and change of shed frequency. The yarns known from DE-A-2,008,338 are characterized by a so-called "entanglement resistance". This quantity describes the yarn in terms of a static loading test. It has now been found that the weaving characteristics of a yarn are dependent not only on good cohesion but significantly also on the opening tendency of the yarn under dynamic-mechanical stress. For this— as will be defined hereinafter—the magnitude of the opening tendency $VS(K_F)$ is a significant quality criterion. The yarns claimed in the present invention make it possible to provide warps of size-free flat yarns which give trouble-free processing in weaving machines having change of shed and weft insertion frequencies of >200/min, in particular in air weaving machines. It has now been found that the weaving characteristics of a yarn are very significantly dependent on the opening tendency of the yarn under dynamic-mechanical stress and on good cohesion.

If prior art yarns are to be used for example as size-free warp yarns under the conditions as prevailing on today's modern weaving machines, the result is generally failure; in particular in the case of flat multifilament yarns. These yarns either pill up and break in the future or they break at once or the weaving machine can be prevented by pill-based stoppages from running adequately or at all or at an efficiency better than an uneconomical 80%, so that continuous operation over a prolonged period is hardly possible.

For instance, it is stated in EP-B-332,980 that a flat filament yarn can these days only be sized successfully with sizes of maximum adhesion and abrasion resistance. EP-A-323,986 discloses a process for preintermingling a partially drawn polyester POY feed yarn wherein the feed yarn is intermingled at a certain air pressure. The good interfilament cohesion of the products obtained is pointed up. The document only reveals that this yarn guarantees trouble-free unwinding in the course of further processing. It does not contain any observations as to whether the yarn product would withstand the special stresses of weaving without the application of a size.

JP-A-58-70,724 discloses an unsized and untwisted multifilament polyester yarn which is suitable for use as a warp yarn for producing woven fabrics. The yarn is characterized by a breaking tension of at most up to 2 g/denier.

Furthermore, DE-A3,903,970 discloses a drawing and intermingling process for producing flat polyester yarn wherein the yarn has to be spread out to form a ribbon. The document does not contain any statement that such yarns can be used as a warp, let alone as a size-free warp.

The advantages of yarns which can be woven without high twist and without the use of sizes reside not only in the economic but also in the ecological sector. On the one hand, sizing is a further process step in the production of woven fabrics and accordingly creates costs. On the other, sizes are usually removed from the fabric after weaving, which creates additional costs, wastes and environmental loads.

There is accordingly a need for yarns which can be woven without the use of sizes or high twist levels.

Experiments have shown that a mere raising of the degrees of intermingling of yarns—analogously to twisting to a high level—did not bring the desired success.

Intermingled yarns have hitherto been characterized by determining their degree of intermingling. This is done with the aid of known intermingling testers.

Examples are needle testers and mechanical or optical thickness/thinness sensors.

The degree of intermingling is usually reported in terms of the needle test value measured using the Rothschild needle tester R 2040 or else in terms of the HOOK DROP test as described in U.S. Pat. No. 2,985,995; or the number of intermingling knots per unit length was measured, for example using the Reutlingen Interlace Counter or the "ITEMAT" from Enka Tecnica. Both the measurements measure the interfilament compaction of the yarn. These methods thus provide information about the length and number of the yarn segments compacted or left open by the intermingling.

However, these methods do not make it possible to make a statement about the opening characteristics of the intermingled yarn under dynamic-mechanical stress, especially about how such a yarn will perform on use as a warp thread on a weaving machine.

There have already been efforts to determine the opening characteristics of yarns. They include the inclusion of pretensioners upstream of devices for determining the interfilament cohesion, for example the inclusion of such devices upstream of the Reutlingen Interlace Counter (cf. Chemiefasern/Textilindustrie, 29(10), pp. 862–4 (1979)). This makes it possible to pretension the in-test yarn uniaxially in a defined manner. However, the stress on the yarn is static, which cannot adequately characterize all the possible uses, for example the characteristics of the yarn on a weaving machine.

The present invention provides a flat multifilament yarn which is weavable without the application of size even under the requirements of modern, high-speed weaving machine systems.

The invention accordingly provides a flat multifilament yarn with low opening tendency of the mutually bound-together filaments, expressed by the quantity $VS(K_F)>42\%$ and with good compaction, expressed by the quantity $(VG_{mean}/VG_{max}) * 100\%>45\%$, especially $>50\%$ the VG quantities being degrees of intermingling determined using the Rothschild needle tester model 2040, $VG_{mean}$ being the arithmetic mean of 20 needle test measurements, and $VG_{max}$ being the maximum value of 20 needle test measurements and where $VS(K_F)$ is the intermingling stability at a given total yarn tension $K_F$ determined by measuring the opening tendency of the flat multifilament yarn under dynamic-mechanical stress by the following method:

a) determining the degree of intermingling $VG_{init}$ of the flat multifilament yarn to be tested using the Rothschild needle tester R 2040, b) feeding the flat multifilament yarn into a testing zone of defined length in which the yarn path undergoes a deflection and which is formed at the beginning and end of transport devices for the yarn and of a radial force measuring device disposed between the transport devices, the angle between the two parts of the yarn path being about 50° to about 5°, and the deflection being caused by the arrangement of the transport devices and of the radial force measuring device, and movement of the flat multifilament yarn through the testing zone under a given static yarn-pulling force, c) periodically deflecting the flat multifilament yarn moving through the testing zone at a frequency which corresponds to the change of shed frequency of a weaving machine, in particular 8 to 35 hertz, perpendicularly to the yarn axis by a predetermined length by means of a deflecting device which acts within the testing zone on the flat multifilament yarn to be tested in such a way that maximum deflection produces within the flat multifilament yarn a total yarn tension $K_F$ from 0.1 to 1.0 cN/dtex which is composed of a proportion of the static yarn-pulling force and a proportion of the dynamic yarn-pulling force acting periodically on the yarn and caused by the deflecting, d) determining the yarn-pulling force $K_F$ acting on the flat multifilament yarn during its passage through the testing zone by means of the radial force measuring device, $K_F$ being taken as the force which acts on the flat multifilament yarn between two deflections of the flat multifilament yarn due to the deflecting device, e) determining the degree of intermingling $VG_{end}$ of the yarn treated in the testing zone using the Rothschild needle tester R 2040, and f) determining the intermingling stability VS at a given total yarn tension $K_F$ according to the relation $VS(K_F)=(VG_{init}/VG_{end}) * 100(\%)$.

A flat multifilament yarn for the purposes of this invention is a multifilament yarn which consists of a multiplicity of individual filaments and which is not a highly twisted yarn. Generally, the yarn of the invention is virtually free of twist; at most, the yarn of the invention may have a protective, producer twist—just enough twist to hold it together, for example up to 50 turns/m.

The single FIGURE of drawing illustrates the yarn of the present invention.

Suitable flat multifilament yarns include virtually all yarns which are composed of continuous filaments and in the course of the production or further processing of which a stabilization has taken place. This includes for example inter-rubbed, inter-welded, inter-adhered, inter-molten or in particular intermingled flat yarns.

Examples thereof are one- or multi-component flat filament yarns which have been subjected to a stabilization, such as intermingling, preferably air intermingling.

As regards the yarn-forming materials, the yarns of the invention are not subject to any restrictions, as long as yarns composed of continuous filaments can be produced therefrom. The yarns can be composed of regenerated natural polymer fibers, for example yarns composed of cellulose fibers, or in particular yarns composed of synthetic fibers, for example of polyamides, polyolefins, polyacrylonitrile or in particular polyesters, such as polyethylene terephthalate or polybutylene terephthalate.

Particular preference is given to filament yarns composed of synthetic fibers, in particular of polyester, which have very particularly preferably been air-intermingled.

The yarns can also be present in the form of filament mixtures and/or plied.

Very particular preference is given to flat yarns composed of drawn multifilaments, in particular those of the designations 76 dtex 128 filament, 100 dtex 128 filament, 76 dtex 64 filament, 50 dtex 80 filament and 50 dtex 40 filament.

"Weavable without size" is to be understood as meaning for the purposes of this invention a flat multifilament yarn which, when used as a warp, is industrially usable in an otherwise customary weaving process and which requires no application of size for carrying out precisely that waving process. However, this does not mean that this yarn will not have any of the customary spin or fiber finishes applied to the yarn for example for carrying out or facilitating production or further processing steps prior to the actual weaving process.

The present invention is made possible, inter alia, by the discovery that weaving sizes can be dispensed with if yarns having a certain opening tendency are used and that simple methods have to be available for testing such yarns.

One such test method is the above-described method for measuring the opening tendency of the flat multifilament yarn under dynamic-mechanical stress. This method makes it possible to provide adequate simulation of weaving machine conditions and to develop yarns which meet the desired requirements profile.

The determination of the degrees of intermingling $VG_{init}$ and $VG_{end}$ of the in-test yarn can be carried out in a manner known per se. Examples of intermingling testers are needle testers or preferably mechanical or in particular optical thickness/thinness sensors.

Examples of mechanical thickness/thinness sensors are the Reutlingen Interlace Counter as described in Chemiefasern/Textilindustrie, 29(10), pp. 862–4 (1979) and the Itemat tester for interlacing as described in Chemiefasern/Textilindustrie, 36/88, pp. 99 ff. (1986).

Examples of optical thickness/thinness sensors are described in EP-A-465,842 and EP-A-340,600; these are in the widest sense systems which, with the aid of optical methods, such as shadowing, diffraction or reflection, make it possible to correlate the measured variable with the thick/thin places of the yarn under test.

In the above-given description of the yarn according to the invention, the definition included the determination of the degrees of intermingling VG with the aid of the Rothschild needle tester model 2040. However, this does not mean that the determination of VG can only be carried out with that instrument.

The term "degree of intermingling" is to be understood within the meaning of this description as a measured value which is attained on testing the yarn according to the invention, i.e. even a non-intermingled yarn (for example a welded-together yarn), with an intermingling tester. This variable measures the interfilament compaction of the yarn, i.e. the length and number of the compacted or open yarn segments.

The test method described makes it possible to determine the change in the compaction and/or the degree of intermingling of the yarn according to the invention under realistic conditions under a given static yarn tension and under an additional dynamic-mechanical load.

To simulate the tension on the yarn in the testing zone, the yarn is subjected within the zone to a deflection and is guided under a predetermined and non-pulselike tension. For this purpose the yarn undergoes a single instance within the testing zone of a deflection, the angle between the two parts of the yarn path being about 50° to about 5°, and the deflection being caused by the arrangement of the transport devices and of the radial force measuring device.

To simulate the tension on the yarn within the testing zone, the yarn is transported between two transport devices under a given static tension. The tension can be controlled in a manner known per se, for example by controlling the speed of the transport rollers.

During the test, the static yarn tension is monitored by means of the yarn-pulling force measuring device.

Within the testing zone the yarn is thus guided under a predetermined and non-pulselike tension.

The transport devices can be any device suitable for yarn transportation. Examples are commercially available, motor-driven godets or else delivery systems, preferably frequency-controlled.

Preferably the transport devices are pairs of rollers around which the in-test yarn is guided repeatedly and whose speed can be controlled separately. This makes it possible for example to simulate the tension in a warp.

The yarn-pulling force measuring device can likewise be any device suitable for this purpose. Examples are the Rothschild Tensiometer, the Honigmann Tensitron, the Denkendorf yarn tension tensor, and the yarn tension meter from REES.

The length of the testing zone can vary within wide limits; typical values range from 50 to 3000 cm, preferably from 150 to 200 cm (weaving machine dimensions).

To simulate the additional dynamic-mechanical load on the yarn within the testing zone, the yarn undergoes within the testing zone a periodical deflection perpendicularly to the yarn axis about a predetermined length and at a predetermined frequency. This is done by means of a deflecting device which acts on the in-test yarn within the testing zone. The deflecting device can be any apparatus suitable for this purpose.

Examples of deflecting devices are pistons or cams working perpendicularly to the yarn axis and in particular wings which rotate perpendicularly to the yarn axis and which exert a beat, defined in terms of amplitude and frequency, on the moving yarn.

The frequency of the deflecting device can likewise vary within wide limits; similarly the magnitude of the tension pulses to be applied to the yarn. For the purposes of the present invention, frequency and tension pulses are chosen within an order of magnitude so as to simulate the behavior of a warp in a weaving machine.

Typical values of the frequency of the deflecting device range from 5 to 50 Hz, preferably within the range from 8 to 35 Hz.

Typical values of the magnitude of the tension pulses to be applied to the yarn are within such a range that the total tension on the yarn—i.e. the sum total of static yarn tension and proportion of the periodic tension on the yarn (values of the tension amplitude)—vary within the range from 0.05 to 1.0 cN/dtex, preferably within the range from 0.1 to 0.7 cN/dtex.

Very particular preference is given to using the above-described process for characterizing thread chains. For this purpose the yarn is passed through the testing zone in the form of a thread chain. The testing takes place either successively on individual yarn strands or on a plurality of yarn strands of the thread chain or else on all yarn strands of the thread chain. Preferably such thread chains consist of two to five yarns; preferably the deflecting device acts on a plurality of such yarns.

The testing method described yields as measured variables the degrees of intermingling $VG_{init}$ and $VG_{end}$, for example as the number of nodes of intermingling per unit length of the yarn.

One test parameter is the opening tendency of the yarn according to the invention under the testing conditions in the testing zone.

The evaluation of the measured variables $VG_{init}$ and $VG_{end}$ at a given total yarn tension $K_F$ can be carried out in various ways.

The ratios $VG_{init}/VG_{end}$ and $VG_{end}/VG_{init}$ at a certain total yarn tension $K_F$ are a characteristic of the behavior of the yarn under dynamic-mechanical load.

For the purpose of describing preferred yarns according to the invention, the measure of opening tendency under dynamic-mechanical stress on these yarns is taken to be an intermingling stability VS ($K_F$) at a certain total yarn tension $K_F$ and under a certain tension pulse of a given frequency according to the relation $$VS(K_F)=(VG_{init}/VG_{end}) * 100(\%)$$

The total yarn tension $K_F$ is for the purposes of the present description taken to be the sum total of static yarn tension and a proportion of the dynamic yarn tension acting periodically on the yarn and caused by the deflecting and prevailing in the deflected yarn in the course of its transport through the testing zone.

The distribution of the measured values of the degrees of intermingling VG of yarns usually conforms to a Poisson function. This function, however, is—assuming the same means—dependent on different parameters, such as yarn material, the conditions during the creation of the cohesion and yarn transportation conditions, and varies greatly in its width.

The test method described makes it possible, in addition to the means of the distribution of the degree of intermingling for a certain yarn, to provide an additional and more meaningful criterion for the compaction of the yarn.

It was found that especially the sue as a size-free warp yarn makes it problematical to operate with the means of the distribution of the degrees of intermingling. It was further found that it is advisable here to use, instead of these means of the degree of intermingling, the extreme values of a series of measurements, since they generally determine the running characteristics of these yarns on a weaving machine.

It was found that the running behavior of flat multifilament yarns on a weaving machine presupposes good compaction as characterized by the above-defined variable $(VG_{mean}/VG_{max}) * 100\% > 45\%$, preferably 50%, in particular >67%, particularly preferably 55 to 67%.

In a further preferred embodiment, the yarn of the invention, in addition to the above-indicated variables $VS(K_F)$ and $VG_{mean}/VG_{max}$, has $VG_{max}$ values >30 mm, preferably from 11 to 22 mm, in particular from 18 to 22 mm, determined on the Rothschild needle tester model 2040.

In a further preferred embodiment, the yarn of the invention, in addition to the above-indicated variables $VS(K_F)$ and $VG_{mean}/VG_{max}$, has $LK_{mean}$ values >15 mm, preferably >6.0 mm, particularly preferably 1.6 to 5.6 mm, $LK_{mean}$ being the mean length between the intermingling nodes determined according to the relation $$LK_{mean}=(1000-(VG_{mean} * IL_{mean}))/IL_{mean}$$

where $VG_{mean}$ is as defined above, determined via the Rothschild needle tester model 2040, and $IL_{mean}$ is the mean number of intermingling nodes per yarn meter determined using the Reutlingen Interface Counter or an ITEMAT.

Preferred flat multifilament yarns of the invention have $VS(K_F)$ values ranging from 60 to 100%.

Particular preference is given to flat multifilament yarns, as defined above, whose $VS(K_F)$ value is 45–90% measured at a frequency of 15 hertz and at such a maximum deflection in step c) that the maximum deflection produces in the flat multifilament yarn a total yarn tension $K_F$ from 0.2 to 0.42 cN/dtex (measured using the Denkendorf yarn tension tensor DEFAT).

Particular preference is given to the flat multifilament yarns of the invention being size-free and present in the form of a warp. It is known that warps of high thread densities are particularly difficult to weave. It was found that the yarn of the invention is weavable without the application of size in the form of warps having high thread densities.

The invention therefore also provides warps where the thread densities are more than 20 threads/cm, especially not less than 40 threads/cm.

The filament linear density of the flat multifilament yarns according to the invention can vary within wide limits; typically this linear density is from 0.3 to 6.5 dtex, preferably from 0.6 to 1.5 dtex, and very particularly preferably less than 1.0 dtex.

The yarn linear density of the flat multifilament yarns according to the invention can likewise vary within wide limits; typically this yarn linear density is 20 to 600 dtex, preferably 40 to 400 dtex. The number of filaments in the flat multifilament yarn of the invention is typically within the range from 20 to 250, preferably from 40 to 180.

Types having lower filament counts are particularly difficult to use as warp yarns. It is therefore particularly surprising that such yarns are still satisfactorily weavable without size without difficulties.

The invention therefore preferably relates to flat multifilament yarns as defined above having filament counts from 20 to 80, in particular from 30 to 50.

The flat multifilament yarns of the invention are notable for high strength; in the case of flat polyester yarns the breaking strengths are more than 2 g/denier, preferably more than 3 g/denier.

Usually the flat multifilament yarns of the invention are fluid-intermingled multifilament yarns, preferably air-intermingled multifilament yarns.

The invention also provides a process for producing intermingled flat multifilament yarns which are weavable without the application of size. It was found that flat multifilament yarns having adequate compaction and opening tendency for size-free weaving can be produced when the yarn is guided with low tension at the site of intermingling and preferably not only with low tension but with a particularly constant tension. In the process of the invention, the yarn tension at the site of intermingling must not exceed a value of 0.6 cN/dtex.

The invention therefore also provides a process for producing intermingled flat multifilament yarns which are weavable without size, comprising the measures of i) presenting at least one one- or multi-component multifilament feed yarn and feeding this multifilament feed yarn to at least one intermingling jet, ii) intermingling the multifilament feed yarn in the intermingling jet by means of a fluid, preferably air, under such an overfeed of the multifilament feed yarn and under such an overfeed of the multifilament feed yarn and under such a pressure of the intermingling fluid as to form an essentially flat, intermingled multifilament yarn, with or without application to the yarn upstream and/or downstream of the site of intermingling of a liquid which is not a size and iii) withdrawing the intermingled flat multifilament yarn from the intermingling jet, with the proviso that the tension on the yarn is chosen in such a way that it is under a tension of not greater than 0.6 cN/dtex at the site of intermingling.

The process of the invention is particularly preferably carried out in such a way that, at the site of intermingling, the yarn tension is kept particularly constant, in particular that the variation of the yarn tension is less than +/−0.1 cN/dtex. This constancy in the tension is achievable by measures known per se, for example by controlling and regulating delivery systems or godets by means of frequency rectifiers.

The feed yarns used can be any desired single- or multicomponent filament yarns; these yarns are generally drawn prior to being intermingled, provided they are not filament yarns which have been spun at very high speeds and are no longer drawable.

The feed yarns are customarily fully drawn yarns, i.e. yarns whose ultimate tensile strength extension at 25° C. is less than 80%.

The orienting and drawing of the yarns can be carried out in a manner known per se. For instance, a fully oriented yarn (FOY) can be produced during the spinning process and this yarn need generally no longer be drawn; or it is possible to produce a yarn which can be made into a drawn yarn in a subsequent afterdrawing process. These latter afterdrawably yarns are usually LOY, MOY, HOY or POY yarns. The terms LOY, MOY, HOY, POY and FOY are common knowledge and described for example in Chemiefasern/Textilindustrie, 6/1985, pp. 411–2.

The drawing can directly adjoin the spinning process or be carried out in a separate stage, for example combined with a customary aftertreatment, such as setting.

The drawing can also take place directly prior to feeding into the intermingling jet, for example by means of upstream drawing godets. This variant can be carried out within an aftertreatment zone or integrated in the spinning process upstream of the site of intermingling.

The drawing and intermingling can be carried out successively in one stage, for example by intermingling an FOY yarn directly in the spinning chimney prior to the winding up of the yarn. However, it can also be carried out in a subsequent process, for example by rewinding or recopsing.

The drawing and intermingling can also be carried out in two or more stages. For instance, yarns can be partially oriented during spinning, for example LOY, MOY, HOY or POY yarns, and can then be drawn in a subsequent stage, for example in the course of draw-winding or draw-twisting. Here the intermingling takes place in a subsequent process stage after the yarn was drawn and before it is wound up.

In a preferred embodiment of the process according to the invention, the intermingling is integrated in a conventional apparatus for carrying out textile processes which has godet pairs which permit a low-tension guiding of the yarn. Examples thereof are texturing devices, twisting devices or regrinding devices. These devices can additionally be equipped with drawing means, for example with pairs of godets moving at different speeds.

The invention preferably provides an intermingling process, as defined above, wherein the multifilament feed yarn used is a yarn whose ultimate tensile strength extension at 25° C. is less than 80% which is intermingled in a conventional apparatus for carrying out textile processes which comprises godet pairs which permit a low-tension guiding of the yarn and between which godet pairs is situated at least one intermingling jet.

The invention preferably provides an intermingling process as defined above, wherein the multifilament feed yarn used is a yarn whose ultimate tensile strength extension at 25° C. is more than 80% which is subjected, directly prior to the intermingling, to a drawing so that its ultimate tensile strength extension at 25° C. after drawing is less that 80% and which is subsequently intermingled, the drawing means and at least one itermingling jet being integrated in a conventional apparatus for carrying out textile processes which has godet pairs which permit a low-tension guiding of the yarn and between which godet pairs there is situated at least one intermingling jet.

Preference is given to using an FOY yarn in the process of the invention, in particular an FOY yarn which within a single-stage process is directly after the spinning carried off to the intermingling, a tension isolation being effected between spinning process and intermingling. This is preferably done by means of pairs of rollers around which the yarn is guided without slippage prior to entry into the intermingling jet.

It is possible to choose single- or multi-component yarns which enter the intermingling unit in single or else multiple form and leave it in either case as a compact yarn.

The intermingling can also be carried out in multiple stages, in which case the yarn passes through a plurality of intermingling jets connected in series.

In the case of a plurality of intermingling jets being connected in series, these can either all be disposed in a tension-isolated zone or in more than one tension-isolated zone connected in series.

The presentation and feeding of the multifilament feed yarn to the intermingling jet is effected by measures and devices customary per se. In the blasting jet texturing of yarns it is well known that the filament material is fed into the blasting jet at a higher speed than it is withdrawn therefrom. The amount by which the speed of the feeding in exceeds the speed of the withdrawal, expressed in percent based on the withdrawal speed, is known as the overfeed. Care has to be taken during feeding that the overfeed of the multifilament feed yarn is such as to produce a virtually pill- and loop-free yarn. This is customarily the case with overfeeds of less than 3%. In individual cases, however, it is also possible to use higher overfeeds, provided the product yarn is a smooth, intermingled yarn, preferably a flat multifilament yarn which meets the above-defined values in respect of the opening tendency and the interfilament compaction.

The intermingling of the multifilament feed yarn in the intermingling jet is effected by means of a fluid, for example by means of liquids or in particular by means of gases. Air is preferred. The intermingling pressure must be chosen in such a way in any particular case that the required maximum limit for the yarn tension at the site of intermingling is not exceeded and that a flat yarn is formed. Typical values for the intermingling pressure range from 1.5 to 76.5 bar.

Preferably the feed yarn is intermingled with air in the presence of a liquid which wets the feed yarn during the intermingling process, for example water.

Examples of intermingling jets are found in U.S. Pat. No. 2,985,995 whose disclosure content is also part of the subject-matter of the present invention.

After intermingling, the flat multifilament yarn formed is withdrawn from the intermingling jet. This can be done by means of devices known per se, for example with godets. In choosing the take-off tension, care has to be taken to ensure that the tension on the yarn at the site of intermingling is not greater than 0.6 cN/dtex, preferably from 0.1 to 0.4 cN/dtex.

The intermingled flat multifilament yarn can subsequently be subjected to a setting treatment by passing it through a heating device; typical temperatures of the yarn passing through the heating device vary within the range from 60° to 250° C.

The process of the invention can be carried out on individual, folded or unfolded yarns, which are subsequently wound up and processed in a further step into a warp. However, the process can also be integrated into the production of warp beams by carrying out the intermingling by means of a multiplicity of parallel intermingling jets on yarn sheet contemplated for producing the warp beam. Examples of such integrated processes are found in DE-B-2,611,547, EP-A-152,919, EP-A-216,951, DE-A-3,711,767 and DE-A-3,727,262.

In the embodiment of the process according to the invention with more than one intermingling jet, for example with a plurality of intermingling jets connected in series and/or in parallel, the intermingling conditions can be kept identical or else different at each of these jets; especially it is possible to vary the nature of the jets or process parameters such as yarn tension, intermingling pressure or the application of liquid to the yarn upstream and/or downstream of the site of intermingling.

The flat multifilament yarn of the invention is preferably employable in applications in which a low opening tendency of such yarns is a precondition.

Examples of such applications are the use of such yarns without the use of any sizes whatsoever in knitting and in particular in weaving. The invention therefore also provides for the use of these yarns for these purposes.

The examples which follow illustrate the invention without limiting it.

EXAMPLE 1

Production of a Size-free Flat Yarn Chain from 50 dtex 40 Filament FOY

The feed yarn used is a singles polyethylene terephthalate 50 dtex 40 filament FOY with a round filament cross section. The yarn is produced in a manner known per se, for example as described in DE-A-2,117,659.

The feed yarn thus produced is rewound on a winding machine to produce an intermingled yarn. In the course of the rewinding the yarn is air-intermingled with a frequency of 1100 knots/second. The yarn tension at the point of entry into the intermingling jet is kept particularly constant and is less than 0.6 cN/dtex. The wind-up tension is likewise less than 0.6 cN/dtex.

The ready-produced yarn has the following characteristic data:

| Total yarn tension $K_F$ (cN/dtex) | VS ($K_F$) (%) | $VG_{mean}$ (mm) | $VG_{max}$ (mm) | $IL_{mean}$ (1/m) | $LK_{mean}$ (mm) |
|---|---|---|---|---|---|
| unloaded | 100 | 12 | 18 | 76 | 2.5 |
| 0.2 | 96 | 12 | 18 | 73 | 2.0 |
| 0.4 | 86 | 12 | 22 | 65 | 1.6 |
| 0.6 | 57 | 21 | 65 | 43 | 1.3 |

The variables of the above table were measured by the following methods:

| | |
|---|---|
| $K_F$: | Total yarn tension determined with the Denkendorf yarn tension tensor (DEFAT) |
| VS ($K_F$) | Opening tendency (as defined above) determined with the Rothschild needle tester model R 2040 |
| $VG_{mean}$ | Mean needle test value (arithmetic mean of 20 measurements) determined with the Rothschild needle tester model R 2040 |
| $VG_{max}$ | Maximum needle test value (greatest value of 20 measurements) determined with the Rothschild needle tester model R 2040 |
| $IL_{mean}$ | Mean number of intermingling nodes per yarn meter determined with the Reutlingen Interlace Counter |
| $LK_{mean}$ | Mean length between intermingling knots calculated according to the relation $(1000 - (VG_{mean} * IL_{mean})) / IL_{mean}$ |

The ready-produced yarn was beamed onto a weaver's warp beam in 40 ends/cm. This warp was readily processible on a RÜTI air weaving machine.

EXAMPLE 2

Production of a Size-free Flat Yarn Chain from 76 dtex 128 Filament FOY

The feed yarn used is a singles polyethylene terephthalate 76 dtex 128 filament FOY. The yarn is spun in a manner known per se, for example as described in DE-A2,117,659.

The feed yarn thus produced is air-intermingled on-line at a frequency of 5500 knots/second even before being wound up for the first time. The yarn tension at the point of entry into the intermingling jet is kept particularly constant and is less than 0.6 cN/dtex. After the air intermingling, the yarn is wound up. The wind-up tension is less than 0.6 cN/dtex.

The ready-produced yarn has the following characteristic data:

| Total yarn tension $K_F$ (cN/dtex) | VS ($K_F$) (%) | $VG_{mean}$ (mm) | $VG_{max}$ (mm) | $IL_{mean}$ (1/m) | $LK_{mean}$ (mm) |
|---|---|---|---|---|---|
| unloaded | 100 | 7.5 | 12.5 | 89 | 4.2 |
| 0.13 | 100 | 7.1 | 11.1 | 85 | 4.8 |
| 0.40 | 100 | 7.1 | 15.2 | 85 | 4.8 |
| 0.66 | 88 | 8.0 | 14.1 | 73 | 5.6 |

The variables of the above table were measured by the following methods:

| | |
|---|---|
| $K_F$: | Total yarn tension determined with the Denkendorf yarn tension tensor (DEFAT) |
| VS ($K_F$) | Opening tendency (as defined above) determined with the Rothschild needle tester model R 2040 |
| $VG_{mean}$ | Mean needle test value (arithmetic mean of 40 measurements) determined with the Rothschild needle tester model R 2040 |
| $VG_{max}$ | Maximum needle test value (greatest value of 40 measurements) determined with the Rothschild needle tester model R 2040 |
| $IL_{mean}$ | Mean number of intermingling nodes per yarn meter determined with the Reutlingen Interlace Counter |
| $LK_{mean}$ | Mean length between intermingling knots calculated according to the relation $(1000 - (VG_{mean} * IL_{mean})) / IL_{mean}$ |

The ready-produced yarn was beamed onto a weaver's warp beam in 40 ends/cm. This warp readily processible on a RÜTI air weaving machine.

EXAMPLE 3

Reproduction of a yarn known from DE-A-2,008,338 and examination of the running behavior of this yarn on different high-speed weaving machines.

Example 1 of DE-A-2,008,338 mentions the following yarn by way of example:

Polyethylene terephthalate 70 den 34 filament; this yarn is intermingled at 2697 m/min under a yarn tension of 17 g at pressures of at least 4.6 atmospheres gauge in the type A jet device more particularly described there. This jet device is commercially available as a "Roto Set".

This yarn is processed according to DE-A-2,008,338 on a shuttle weaving machine as follow:

Weaving with 192 picks per minute on a "Draper-XD shuttle loom" with 129 ends/2.54 cm and 46 picks/2.54 cm; the weft yarn used is a commercial singles blend yarn of polyester staple fibers and cotton of metric count 26; the efficiency is 90%. No details are provided of the fabric construction.

To have a comparison with the property profile of the yarns described and claimed in the present invention, this prior art yarn was reproduced using by way of approximation a 76 dtex 32 filament polyethylene terephthalate yarn and the process and the "entanglement jet means" of DE-A-2,008,338.

An attempt was made to weave the yarn obtained without a size and in a comparable manner on air and water and gripper weaving machines but with change of shed or weft insertion frequencies of greater than 200/min.

Prior to weaving, the intermingled yarn obtained according to DE-A-2,008,338 was examined in respect of its specifications concerning compaction and opening tendency in the manner described in the present invention. The following data were determined for compaction and opening tendency:

| $K_F$ (cN/dtex) | VS ($K_F$) (%) | $VG_{mean}$ (mm) | $VG_{max}$ (mm) | $IL_{mean}$ (1/m) | $LK_{mean}$ (mm) |
|---|---|---|---|---|---|
| 0.00 | 100 | 48 | 89 | 20 | 1.8 |
| 0.20 | 40 | 122 | 326 | 8 | 1.2 |
| 0.40 | 35 | 138 | 430 | 5 | 0.6 |
| 0.60 | 13 | 368 | 1795 | 2 | 0.4 |

It thus remains to be noted that the yarn reproduced according to DE-A-2,008,338 does not meet the specifications given in the claims of the present invention.

On air and water weaving machines this reproduced yarn could not be woven at all. On gripper weaving machines a certain amount of success was obtained up to a change of shed frequency of 300/min in the case of the less critical twill and satin/sateen constructions.

The efficiency (ratio of the time required in practice at the given machine settings at full speed to the theoretically required time), however, was at less than 90% below the currently customary standard.

Even so, it was impossible to produce plain weaves in the density mentioned in DE-A-2,008,338.

What is claimed is:

1. A flat multifilament yarn with low opening tendency of the mutually bound-together filaments, expressed by the quantity $VS(K_f)>42\%$ and with good compaction, expressed by the quantity $(VG_{mean}/VG_{max}) * 100\%>45\%$ the VG quantities being degrees of intermingling determined using the Rothschild needle tester model 2040, $VG_{mean}$ being the arithmetic mean of 20 needle test measurements, and $VG_{max}$ being the maximum value of 20 needle test measurements and where $VS(K_F)$ is the intermingling stability at a given total yarn tension $K_F$ determined by measuring the opening tendency of the flat multifilament yarn under dynamic-mechanical stress by the following method:

a) determining the degree of intermingling $VG_{init}$ of the flat multifilament yarn to be tested using the Rothschild needle tester R 2040, b) feeding the flat multifilament yarn into a testing zone of defined length in which the yarn path undergoes a deflection and which is formed at the beginning and end of transport devices for the yarn and of a radial force measuring device, disposed between the transport devices, the angle between the two parts of the yarn path being about 50° to about 5°, and the deflection being caused by the arrangement of the transport devices and of the radial force measuring device, and movement of the flat multifilament yarn through the testing zone under a given static yarn-pulling force, c) periodically deflecting the flat multifilament yarn moving through the testing zone at a frequency which corresponds to the change of shed frequency of a weaving machine, in particular 8 to 35 hertz, perpendicularly to the yarn axis by a predetermined length by means of a deflecting device which acts within the testing zone on the flat multifilament yarn to be tested in such a way that maximum deflection produces within the flat multifilament yarn a total yarn tension $K_F$ from 0.1 to 1.0 cN/dtex which is composed of a proportion of the static yarn-pulling force and a proportion of the dynamic yarn-pulling force acting periodically on the yarn and caused by the deflecting, d) determining the yarn-pulling force $K_F$ acting on the flat multifilament yarn during its passage through the testing zone by means of the radial force measuring device, $K_F$ being taken as the force which acts on the flat multifilament yarn between two deflections of the flat multifilament yarn due to the deflecting device, e) determining the degree of intermingling $VG_{end}$ of the yarn treated in the testing zone using the Rothschild needle tester R 2040, and f) determining the intermingling stability VS at a given total yarn tension $K_F$ according to the relation $VS(K_F)=(VG_{init}/VG_{end}) * 100(\%)$.

2. The flat multifilament yarn of claim 1 with its good compaction expressed by $(VG_{mean}/VG_{max}) * 100\%>45\%$.

3. The flat multifilament yarn of claim 1 with its good compaction expressed by $VG_{max}>30$ mm, where $VG_{max}$ is determined by the method defined in claim 1.

4. The flat multifilament yarn of claim 1 with its good compaction expressed by the relation $LK_{mean}>15$ mm, where $LK_{mean}$ is the mean length between the intermingling nodes determined according to the relation $$LK_{mean}=(1000-(VG_{mean}-IL_{mean}))/IL_{mean}$$

where $VG_{mean}$ has the meaning defined in claim 1 and is determined via the Rothschild needle tester model 2040, and $IL_{mean}$ is the mean number of intermingling nodes per yarn meter determined using the Reutlingen Interlace Counter or an ITEMAT.

5. The flat multifilament yarn of claim 1 where $VS(K_F)$ is 45–90% measured at a frequency of 15 hertz and at such a maximum deflection in step c) that the maximum deflection produces in the flat multifilament yarn a total yarn tension from 0.2 to 0.42 cN/dtex (measured using the Denkendorf yarn tension tensor).

6. The flat multifilament yarn of claim 5 where $(VG_{mean}/VG_{max}) * 100\%$ is 55 to 67%.

7. The flat multifilament yarn of claim 5 where $VG_{max}$ is 18 to 22 mm.

8. The flat multifilament yarn of claim 5 where $LK_{mean}$ is 1.6 to 2.0 mm, $LK_{mean}$ being defined as in claim 4.

9. The flat multifilament yarn of claim 1 where $VS(K_F)$ is 60 to 100%.

10. The flat multifilament yarn of claim 1 where the cohesion is achieved by air intermingling.

11. The flat multifilament yarn of claim 1 comprising polyester.

12. The flat multifilament yarn of claim 11 having breaking strengths of at least 3 g/denier.

13. The flat multifilament yarn of claim 1 without the application of a size and in the form of a warp.

14. The flat multifilament yarn of claim 13 where the thread density in the warp is at least 20 threads/cm.

15. The flat multifilament yarn of claim 1 wherein the filament count is at least 20.

* * * * *

UNITED STATES PATENT AND TRADEMARK OFFICE

CERTIFICATE OF CORRECTION

PATENT NO. : 5,518,814

DATED : May 21, 1996

INVENTOR(S) : Burkhard Bonigh

It is certified that error appears in the above-indentified patent and that said Letters Patent is hereby corrected as shown below:

Column 2, line 8, "3,008,338" should read -- 2,008,338 --.

Column 4, line 66, "waving" should read -- weaving --.

Column 7, line 22, "sue" should read -- use --; line 35, ">30" should read -- <30 --; line 40, ">15" should read -- <15 --; and line 41, ">6.0" should read -- <6.0 --.

Column 8, lines 44 and 45, delete "under such an overfeed of the multifilament feed yarn and".

UNITED STATES PATENT AND TRADEMARK OFFICE

CERTIFICATE OF CORRECTION

PATENT NO. : 5,518,814
DATED : May 21, 1996
INVENTOR(S) : Burkhard Bonigh

It is certified that error appears in the above-indentified patent and that said Letters Patent is hereby corrected as shown below:

Column 9, line 39, "regrinding" should read -- rewinding --.

Column 10, line 36, "76.5" should read -- 7.5 --.

Column 13, line 34 (claim 1, line 11), "low" should read -- an --; and line 37 (claim 1, line 4) "$VS(K_f)\rangle 42\%$" should read -- $VS(K_F)\rangle 42\%$ --. .

Column 14, line 26 (claim 3, line 3), "$>30$" should read -- $<30$ --; line 31 (claim 4, line 3) "$>15$" should read -- $<15$ --; and line 55 (claim 10, line 2), "cohesion" should read -- compaction --.

Signed and Sealed this

Nineteenth Day of November, 1996

*Attest:*

BRUCE LEHMAN

*Attesting Officer*

*Commissioner of Patents and Trademarks*